United States Patent [19]

Nelson

[11] 4,221,237

[45] Sep. 9, 1980

[54] REFRIGERATION HEAT PUMP CHANGEOVER VALVE ASSEMBLY

[75] Inventor: Richard E. Nelson, Rancho Palos Verdes, Calif.

[73] Assignee: Honeywell Inc., Minneapolis, Minn.

[21] Appl. No.: 920,044

[22] Filed: Jun. 28, 1978

[51] Int. Cl.[3] ..... F16K 11/07

[52] U.S. Cl. ..... 137/625.29; 62/324; 137/625.43

[58] Field of Search ..... 137/625.29, 625.43; 62/324 A

[56] References Cited

U.S. PATENT DOCUMENTS

| | | | |
|---|---|---|---|
| 2,342,566 | 2/1944 | Wolfert | 62/324 |
| 2,976,701 | 3/1961 | Greenawalt | 137/625.29 X |
| 3,037,525 | 6/1962 | Weigers | 137/625.29 |
| 3,400,736 | 9/1968 | Bastle et al. | 137/625.29 |

*Primary Examiner*—Arnold Rosenthal
*Attorney, Agent, or Firm*—Clyde C. Blinn

[57] ABSTRACT

A refrigeration heat pump changeover valve assembly has a cylindrical housing with a slidable valve member in the housing for changing the flow of refrigerant in a refrigeration heat pump system. The evaporator and condenser lines are connected on one side of the housing adjacent each other in line with the axis of the housing. The compressor suction line and discharge or pressure line are connected on the other side of the housing opposite the evaporator and condenser lines adjacent each other at right angles to the axis of the cylindrical housing. The valve member upon moving between a first and a second position upon the operation of a pilot valve connects the suction line to either the evaporator or condenser line when in the first or second position, respectively, and the discharge line is connected to the other line. The valve assembly provides for low pressure drop, straight through flow of the refrigerant into the suction line and from the discharge line to either the evaporator or condenser lines depending upon the operation of the self-contained pilot valve system.

7 Claims, 4 Drawing Figures

REFRIGERATION HEAT PUMP CHANGEOVER VALVE ASSEMBLY

BACKGROUND OF THE INVENTION

1. Field of the Invention

A valve assembly adapted for use with a refrigeration heat pump system wherein the reversal of refrigerant flow is accomplished upon operation of the valve assembly to provide either heating or cooling to a dwelling. The valve assembly has a movable valve member which moves in a cylindrical housing to change the straight through refrigerant flow in the valve. The valve member is operated by a pilot valve system operated by an external actuator.

2. Description of the Prior Art

Refrigeration changeover valve assemblies for providing the reversal of refrigerant flow in a refrigeration heat pump system, such as shown in the Frederick A. Greenwalt U.S. Pat. No. 2,976,701, issued Mar. 28, 1961, have been available for many years. In such changeover valve assemblies a continual desire is to have a minimum pressure drop through the valve, as small a size as possible, a minimum operating power requirement and most important, a low cost of manufacture. The prior art changeover valve assemblies generally have a piston valve member which is controlled by a pilot valve upon the operation of an external actuator so that when the piston valve member is moved, the flow is changed; however, refrigerant flow is greatly restricted in the valves.

SUMMARY OF THE INVENTION

The present invention is concerned with a valve assembly adapted for use with a refrigeration heat pump system wherein the reversal of refrigerant flow is accomplished upon the operation of a pilot valve to actuate a movable valve member in a main housing. The inlet and outlet openings to the housing are positioned so that straight through, minimum pressure drop flow is provided whether the heat pump changeover valve is in a position for providing cooling or heating. The movable valve assembly provides an adequate seal between the pressure or discharge line and suction line of the compressor to maintain the leakage in the valve assembly at a minimum.

DESCRIPTION OF THE PREFERRED EMBODIMENT

Figure 1:
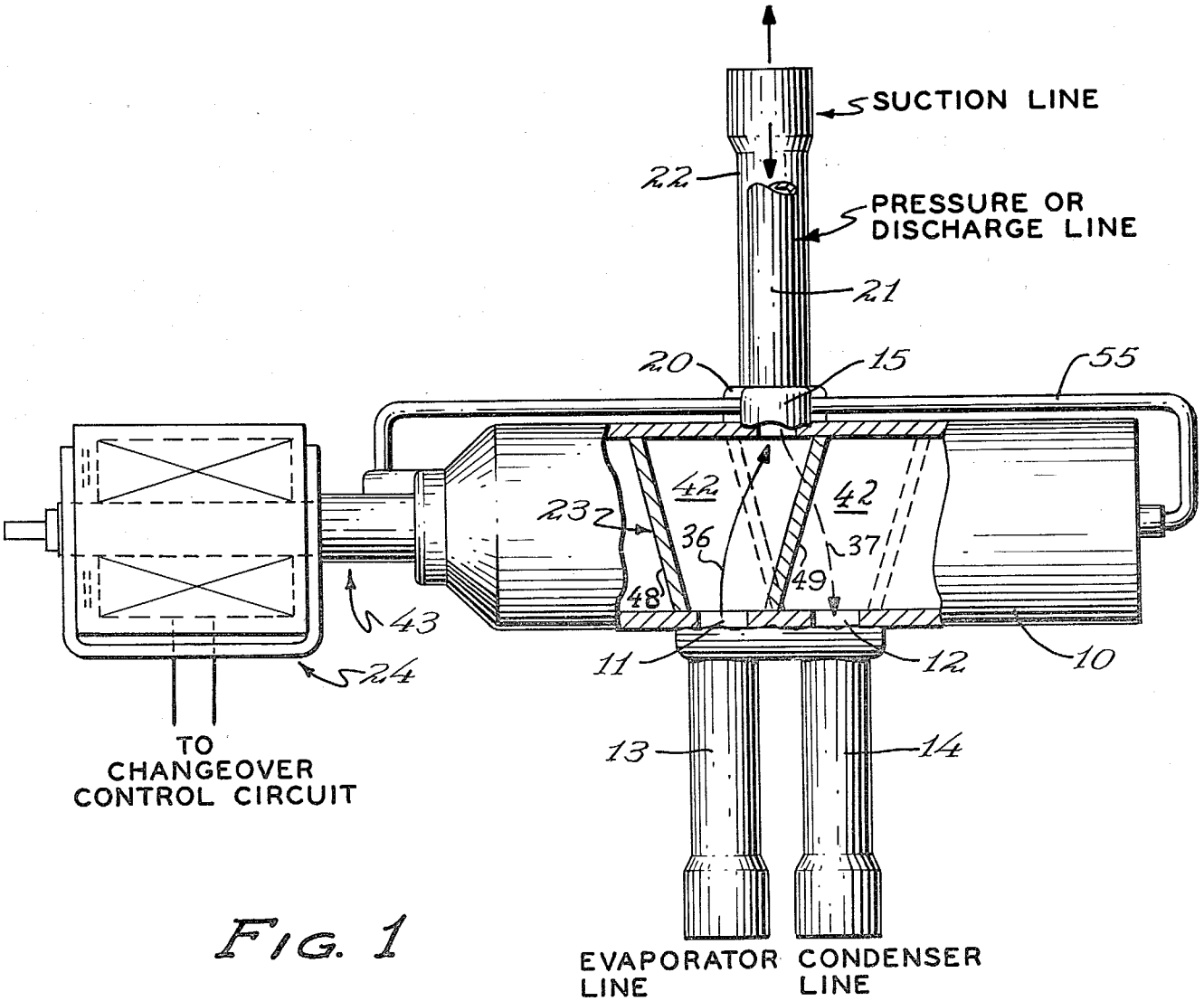
FIG. 1 is a cutaway view of the valve assembly showing the movable valve member in the cooling position for the heat pump refrigeration system.

Referring to FIG. 1, a valve assembly is shown having a cylindrical shaped cavity or housing 10 which has a plurality of openings or inlets and outlets connected to various lines. Openings 11 and 12 on one side or the lower side of housing 10 are adjacent each other in a line parallel to the axis of housing 10. Opening 11 is connected to a tube or evaporator line 13 adapted for connection to an evaporator and opening 12 is connected to a tube or condenser line 14 adapted for connection to a condenser of a refrigeration heat pump system of the type shown in the John W. Mobarry U.S. Pat. No. 3,115,018, issued Dec. 24, 1963. Openings 15 and 20 in the opposite or upper side of housing 10 are adjacent each other in a line at right angles to the axis of the housing, i.e. at right angles to the alignment of openings 11 and 12. Opening 15 is connected to a line or tube pressure 21 adapted for connection to the pressure or discharge of the heat pump system and opening 20 is connected to line or suction tube 22 adadpted for connection to the suction line of the heat pump system.

Figure 2:
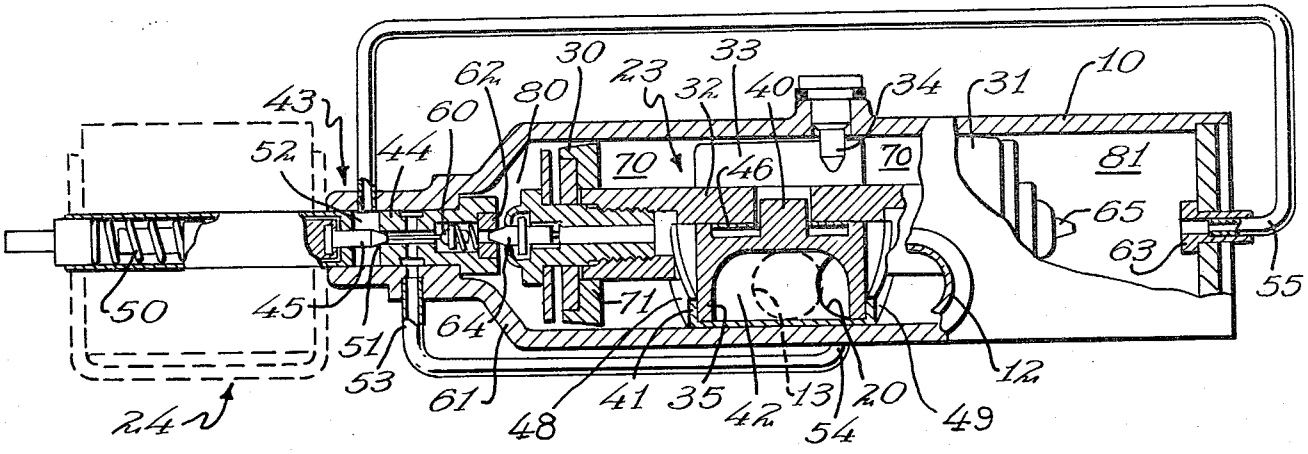
FIG. 2 is a cutaway view of the valve assembly looking upward at FIG. 1 and showing the details of the movable valve member and the pilot valve system.
Figure 4:
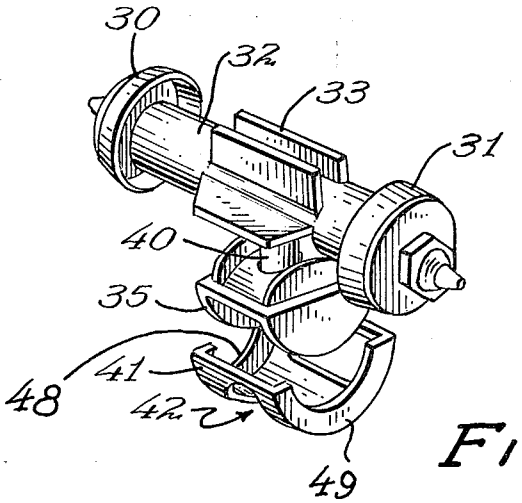
FIG. 4 is a perspective view of the movable valve member assembly showing the pistons connected to the flow director and seal assembly.
Figure 3:
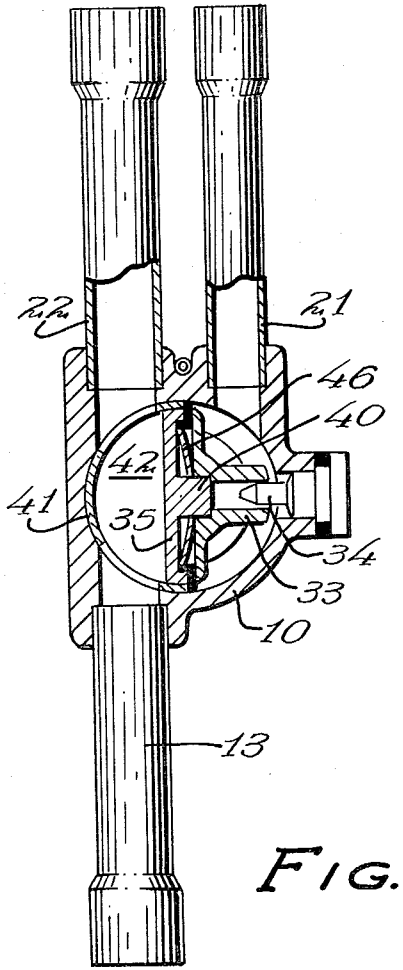
FIG. 3 is a cross-sectional view of the valve assembly of FIG. 1 looking to the right to show the movable valve member and the guiding pin.

A movable valve member or slidable flow control means 23 is shown positioned in a non-energized, cooling operation position to provide flow through the valve assembly from evaporator line 13 to suction line 22 through suction chamber 42, at the back side of housing 10, as shown by line 36. Flow also exists from the pressure or discharge line 21 through pressure chamber 70 (in front of member 23 as shown in FIG. 2) to condenser line 14 as shown by dotted line 37 at the front side of housing 10. Upon energization of actuator 24, the movable valve member 23 moves to the dotted position to reverse the flow through the valve assembly to provide for flow from condenser line 14 to suction line 22 through suction chamber 42 and from pressure line 21 to the evaporator line 13 through pressure chamber 70 to reverse the operation of the heat pump system in which the valve assembly is used.

Referring to FIG. 2, a cutaway detail of the valve assembly of FIG. 1 is shown looking upward at FIG. 1. The movable valve member 23 comprises a pair of pistons 30 and 31 connected to each end of a linking member 32. Linking member 32 has a positioning guide 33 which is received by a guide pin 34 in the housing 10. A U-shaped slide valve holding member 35 is keyed to member 32 at 40 for supporting a valve seating member 41, which has sides 48 and 49 against the inner surface of cylindrical housing 10 to provide a sealed passageway 42 for connecting suction line 22 to the evaporator or condenser lines as mentioned in connection with FIG. 1.

Pilot valve 43 which is contained in the left end of the housing as shown in FIG. 2, has a seating member 44 which has a two position pilot valve actuating member 45 for seating a valve against a seat at one end or the other depending upon the position of member 45 as controlled by the actuator 24. As shown, member 45 is to the right under the bias of spring 50 as actuator 24 is deenergized. Valve 51 is seated to close the passageway from chamber 52 to the suction line 53, which is also connected to the intermediate portion of housing 10 at 54 to always be connected to the suction chamber 42. Chamber 52 is connected by a capillary tube 55 to the other end of housing 10.

A second pilot valve member 60 which is spring biased by a spring 61 against the extension of member 45, closes when actuator 24 is energized to move the member 45 to the left. Thus, depending upon whether the actuator 24 is energized or not, either valve member 51 is against its seat or valve 60 is against its seat to close the flow of fluid into the suction line 53 from one of the other areas. At each end of the cylindrical housing is a valve seating surface 62 and 63 which are engaged by snubber valve members 64 and 65 of the pistons 30 and 31, respectively. The snubber valve members 64 and 65 are substantially the same and are loosely fit members which engage the seating surface to close the valve when its piston it at one end of the housing 10. Passing around these snubber valves 64 and 65 is a gas of fluid passage from the inner pressure chamber 70, the flow of which is controlled by an orifice 71. While only one piston is shown, pistons 30 and 31 are substantially the same, so that gas from the inner pressure chamber 70 can pass through orifices such as 71, past the snubber valve member 64 to the other side of the piston.

OPERATION OF THE PREFERRED EMBODIMENT

Referring to FIG. 1, the valve assembly is shown in the non-energized cooling position wherein the valve member 23 provides flow substantially straight through from the evaporator line to the suction line through chamber 42 and from the pressure or discharge line 21 to the condenser line 14 through the chamber 70. Upon the energization of the changeover actuator 24, pilot valve 43 is operated and valve member 23 moves to the position shown by the dotted lines wherein the flow is reversed, i.e. from the condenser line to the suction line and from the pressure discharge line to the evaporator line.

Specifically, as shown in FIG. 2, valve member 23 is in the position with the piston 30 to the far left and the snubber valve member 64 has closed the valve seat 62 and the pressure on each side of piston 30 has equalized as flow from the high pressure chamber 70 passes through orifice 71 into the chamber 80. In this non-energized position, as mentioned in connection with FIG. 1, flow exists through chamber 42 from the evaporator line to the suction line 20 and from the discharge line 15 to the condenser line 12 through the high pressure chamber 70.

Upon energization of actuator 24 to bring about the reversal of the refrigeration system for heating, the solenoid pulls member 45 to the left against spring 50 to lift valve 51 off of valve seat 44 and allow valve 60 to close under the power of spring 61. Chamber 81 to the far right of piston 31, is then connected through capillary 55, chamber 52 and capillary 53 to the suction chamber 42 at 54 and the pressure in chamber 81 is reduced. As there is a high pressure on the left side of piston 31 and the pressure is equal on each side of piston 30, the valve member will move to the right until snubber valve 65 hits the valve seat 63. In that position, as shown by the dotted lines in FIG. 1, the suction line is connected to the condenser line and the discharge line is connected to the evaporator line. Upon closure of the entrance to capillary 55 by seating valve member 65 against seat 63, the suction line is plugged and high pressure fluid from the chamber 70 leaks past the snubber valve 65 which is substantially the same as valve 71 to equalize the pressure on each side of the piston 31, i.e. of chambers 70 and 81, and the valve assembly stays to the far right position for the heating operation.

Member 35 is forced away from the connector 32 by spring 46 and forces the valve seating surface of member 41 against the inner surface of the housing 10 to provide an adequate seal for the suction chamber 42. As the valve assembly 23 moves from left to right and back, its position is oriented by the pin 34 which rides in the guide 33.

The embodiment of the invention in which the exclusive property or right is claimed are defined as follows:

1. In a valve assembly adapted for use with a refrigeration heat pump system wherein a reversal of refrigerant flow is accomplished upon operation of the valve assembly to provide either heating or cooling to a dwelling, comprising, a cylindrical shaped housing having first and second openings on one side and third and fourth openings substantially opposite said one side, said first and second openings are spaced adjacent each other, said third and fourth openings are spaced adjacent each other, movable valve member slidably mounted in said housing and movable between a first and second position, said valve member having a first portion for connecting said third opening to one of said first or said second openings when in said first position to provide substantially straight through refrigerant flow and when in said second position connecting said third opening to the other of said first and second openings, said valve member upon moving to one of said first and second positions, uncovers one of said first and second openings to provide for substantially straight through refrigerant flow from said fourth opening, actuator means connected to said movable valve member for selectively moving said member to said first or second position, said movable valve member comprises first and second pistons connected by a connecting link, and a member defining a flow path across said cylindrical housing, said member being connected to said connecting link so that depending upon the position of said valve member, flow is directed through said valve between said evaporator and or condenser line and said suction line.

2. The invention of claim 1 wherein said member has a sealing portion engaging the inner surface of said housing for providing a seal between the cross flow chamber and the chamber intermediate said pistons.

3. The invention of claim 1 wherein said valve member comprises, first and second pistons attached by a connecting link slidably mounted in said housing, said connecting link having a piloting guide engaging a pin attached to said housing for maintaining said pistons in a direction parallel to the axis of said housing and said connecting link having a member for providing a flow passage across said housing for the suction line, said member having a U-shaped slide valve for covering said suction opening in said housing regardless of which position the movable valve member is operated in so that said suction chamber is connected to either said evaporator line or condenser line opening in the housing.

4. The invention of claim 3 wherein the pressure line opening of said housing is connected to the chamber between said pistons and is connected to one of the openings not covered by said member or connection to said suction line opening.

5. In a valve assembly adapted for use with a refrigeration heat pump system wherein a reversal of refrigerant flow is accomplished upon operation of the valve assembly to provide either heating or cooling to a dwelling, comprising, a cylindrical shaped housing having first and second openings on one side and third and fourth openings substantially opposite said one side, said first and second openings are spaced adjacent each other, said third and fourth openings are spaced adjacent each other, movable valve member slidably mounted in said housing and movable between a first and second position, said valve member having a first portion for connecting said third opening to one of said first or said second openings when in said first position to provide substantially straight through refrigerant flow and when in said second position connecting said third opening to the other of said first and second openings, said valve member upon moving to one of said first and second positions, uncovers one of said first and second openings to provide for substantially straight through refrigerant flow from said fourth opening, and actuator means connected to said movable valve member for selectively moving said member to said first or second position, said actuator means comprises a pilot valve for operating said movable member to one end or the other of said housing, said pilot valve being contained in an extension of said housing to provide for a compact valve assembly.

6. The invention of claim 5 wherein said actuator includes a solenoid mounted on the extension of said housing to operate said pilot valve for operating said valve member.

7. In a valve assembly adapted for use with a refrigeration heat pump system wherein a reversal of refrigerant flow is accomplished upon operation of the valve assembly to provide either heating or cooling to a dwelling, comprising, a cylindrical shaped housing having first and second openings on one side and third and fourth openings substantially opposite said one side, said first and second openings are spaced adjacent each other, said third and fourth openings are spaced adjacent each other, movable valve member slidably mounted in said housing and movable between a first and second position, said valve member having a first portion for connecting said third opening to one of said first or said second openings when in said first position to provide substantially straight through refrigerant flow and when in said second position connecting said third opening to the other of said first and second openings, said valve member upon moving to one of said first and second positions, uncovers one of said first and second openings to provide for substantially straight through refrigerant flow from said fourth opening, and actuator means connected to said movable valve member for selectively moving said member to said first or second position, said first and second openings are spaced adjacent each other in line with an axis of said housing and said third and fourth openings are spaced adjacent each other at right angles with said axis.

* * * * *